US007152323B1

(12) United States Patent
Lin

(10) Patent No.: US 7,152,323 B1
(45) Date of Patent: Dec. 26, 2006

(54) FLUSHING AND FLOW GUIDING DEVICE FOR ELECTRIC NOSE HAIR CUTTER

(76) Inventor: Mark Y. S. Lin, No. 42, Alley 33, Lane 514, Chung-Cheng Rd, Shin-Chuang City, Taipei Hsiang (TW)

( * ) Notice: Subject to any disclaimer, the term of this patent is extended or adjusted under 35 U.S.C. 154(b) by 0 days.

(21) Appl. No.: 11/116,618

(22) Filed: Apr. 29, 2005

(51) Int. Cl.
*B26B 19/38* (2006.01)

(52) U.S. Cl. ..... 30/29.5; 30/41.5

(58) Field of Classification Search ..... 30/29.5, 30/34.05, 41, 41.5, 43.4, 43.5, 43.6, 240, 30/263, 264, 205, 206
See application file for complete search history.

(56) References Cited

U.S. PATENT DOCUMENTS 3,546,777 A * 12/1970 Katsuji ..... 30/29.5
4,370,807 A * 2/1983 O'Neill ..... 30/41.5
5,012,576 A * 5/1991 Johannesson ..... 30/29.5
2005/0005453 A1* 1/2005 Egeresi ..... 30/34.1

* cited by examiner

*Primary Examiner*—Hwei-Siu Payer
(74) *Attorney, Agent, or Firm*—Egbert Law Offices

(57) ABSTRACT

A flushing and flow guiding device for an electric nose hair cutter includes a spiral guiding plate located at an outer periphery of an inner blade seat. The spiral guiding plate has an outer radius, smaller than an inner radius of an outer blade seat. By a rotation of the inner blade seat, the spiral guiding plate can drive detergent filled in an inner barrel inside the outer blade seat. By rotating the spiral guiding plate clockwise or counterclockwise, the detergent can be sucked in from a front end of the outer blade seat of the nose hair cutter and then expelled through a periphery at a lower end of the outer blade seat, or can be sucked in from the periphery at the lower end of the outer blade seat, and then expelled through the front end, in order to flush nose hair debris in the blade seat.

1 Claim, 5 Drawing Sheets

FLUSHING AND FLOW GUIDING DEVICE FOR ELECTRIC NOSE HAIR CUTTER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a flushing and flow guiding device for an electric nose hair cutter, and more particularly to a spiral guiding plate installed at an outer periphery of a mobile inner blade seat to form a screw pump, which is suitable for driving liquid without easily blasting air, in an inner barrel of an outer blade seat, thereby driving detergent in the inner barrel to flush nose hair debris in the blade seat.

BACKGROUND OF THE INVENTION

An electric nose hair cutter, which is the same as an electric shaver, can leave hair debris inside a blade seat. These tools are cleaned primarily with an attached brush in early days. For a waterproof tool, especially the electric nose hair cutter, a drain hole is usually mounted at a bottom end or a side of its blade seat for flushing. As the inner blade seat of the electric nose hair cutter is a cylinder without a smooth surface, it is equipped with a function of expelling water upon rotating. However, there is still an improved structure for enhancing the function of expelling water on the market, which includes primarily a radial leaf plate 42A installed on the inner blade seat 4A as shown in FIG. 7. In other words, an air blasting pump is formed between an outer blade seat 3A and the inner blade seat 4A, and a side hole 32A is located on the outer blade seat 3A at a location corresponding to the leaf plate of the inner blade seat 4A, so as to accelerate suction of water from a front end and to expel it from the side hole. However, as the air blast pump can drive air, whose density is much lower than that of water, to flow quickly, therefore the tiny hair debris also scatters easily into air upon using, and thus forming a kind of pollution.

BRIEF SUMMARY OF THE INVENTION

The primary object of the present invention is to provide a flushing and flow guiding device for an electric nose hair cutter which can drive liquid to flow without blasting air. The present invention comprises primarily a spiral guiding plate mounted at an outer periphery of a dynamic inner blade seat. The outer radius of the spiral guiding plate is a little smaller than an inner radius of a static outer blade seat, so as to form a synchronous screw pump thereby enabling the spiral guiding plate to drive detergent filled in an inner barrel of the outer blade seat for flushing the nose hair debris in the blade seat.

To enable a further understanding of the said objectives and the technological methods of the invention herein, the brief description of the drawings below is followed by the detailed description of the preferred embodiments.

DETAILED DESCRIPTION OF THE INVENTION

Figure 1:
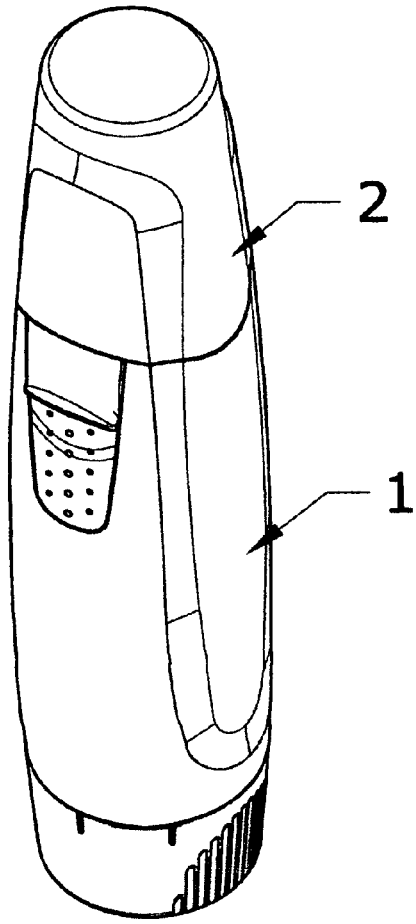
FIG. 1 shows a schematic view of an appearance of an electric nose hair cutter.

Referring to FIG. 1, it shows a general appearance of an electric nose hair cutter having a body 1, an upper casing 2 on the body for covering a blade seat member, and a battery cap below the body.

Figure 2:
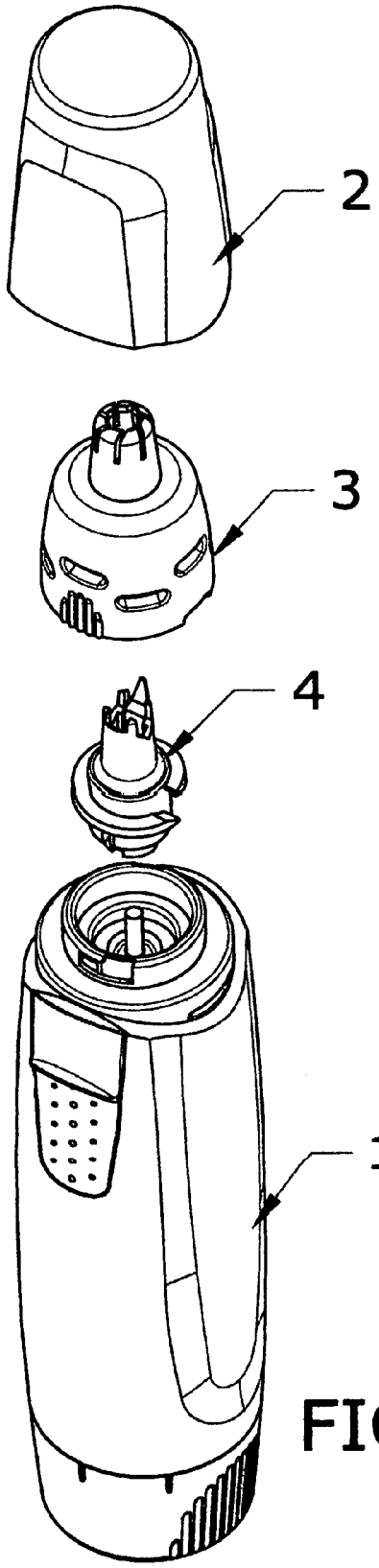
FIG. 2 shows an exploded perspective view of an implementation of the. present invention.

The aforementioned blade seat member is mounted at a top of the body 1 as shown in FIG. 2. The blade seat member includes an outer blade seat 3 and an inner blade seat 4, along with an outer blade at a top of the outer blade seat 3. A front hole 31 is located at a top of the outer blade seat 3, and two lower holes 32,33 are located at a side in a bottom of the outer blade seat 3. An elastic inner blade 41 is mounted on a top of the inner blade seat 4, and a spiral guiding plate 42 is installed at a periphery of the lower section of the inner blade seat 4. A middle hole 43 which passes through axially is installed in a middle location of the inner blade seat 4, and is connected to a side hole 44 at a bottom end of middle hole 43. The inner blade seat 4 is dynamically mounted on a shaft protruded from a top end of the body 1, and is installed inside the outer blade seat 3.

Figure 3:
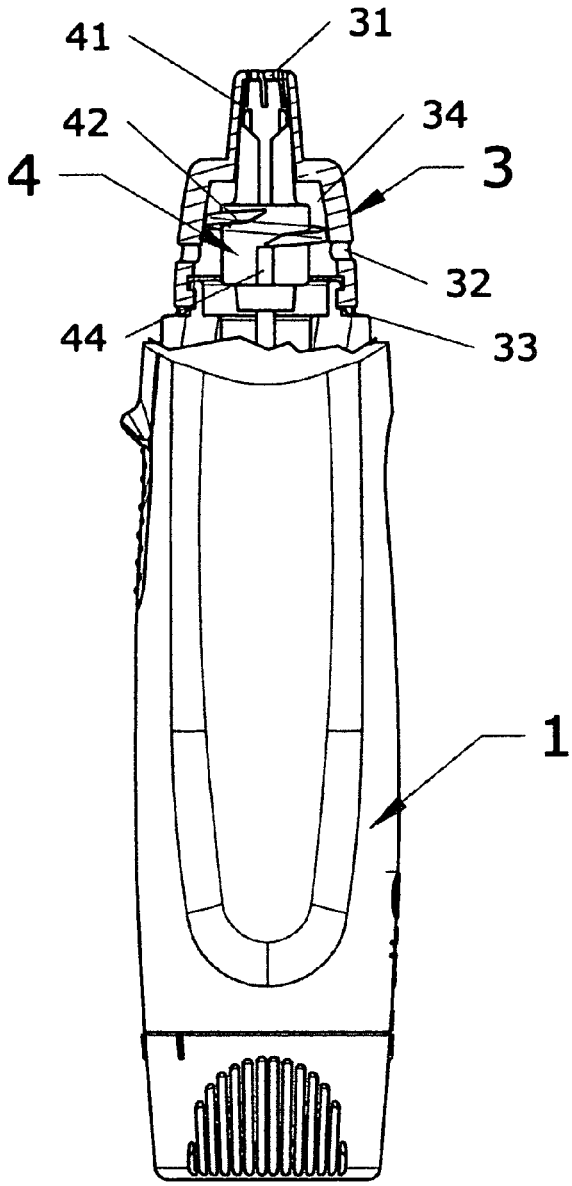
FIG. 3 shows a sectional view of a structure of an outer blade seat of the present invention.

The primary feature and function of the present invention lies in the interior of the blade seat member. As shown in the sectional view (cutaway of the outer blade seat) of structure of the present invention of FIG. 3, a hollow inner barrel 34 is located inside the aforementioned outer blade seat 3. Upon installing the inner blade 4 inside the outer blade seat 3, the outer radius of the spiral guiding plate 42 is close to the wall of inner barrel 34, thereby enabling the spiral guiding plate 42 to form a guide way that flows axially in the inner barrel 34. The spiral guiding plate can be in a design of single thread or multiple threads.

Figure 4:
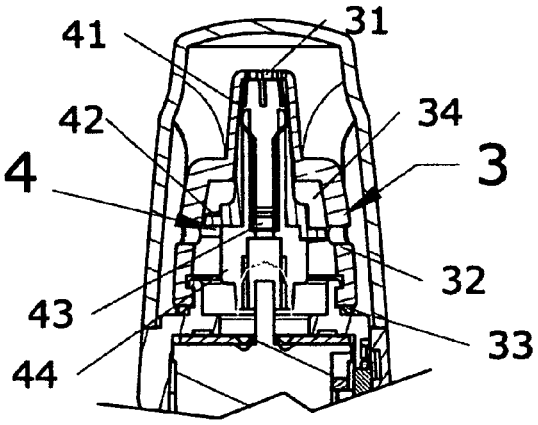
FIG. 4 shows a sectional view of an inner and an outer blade seat of the present invention.

Referring to FIG. 4, it shows a cutaway view (including the cutaway of inner and outer blade seat) of the present invention. The middle hole 43 is located at the location of the central inner blade 41 in the inner blade seat 4, and the lower end of the middle hole 43 is connected to the side hole 44. Therefore, not only a water flow can pass through a gap between the inner and outer blade seat, but also a part of the water flow can flow through the middle hole 43 and the side hole 44.

Figure 5:
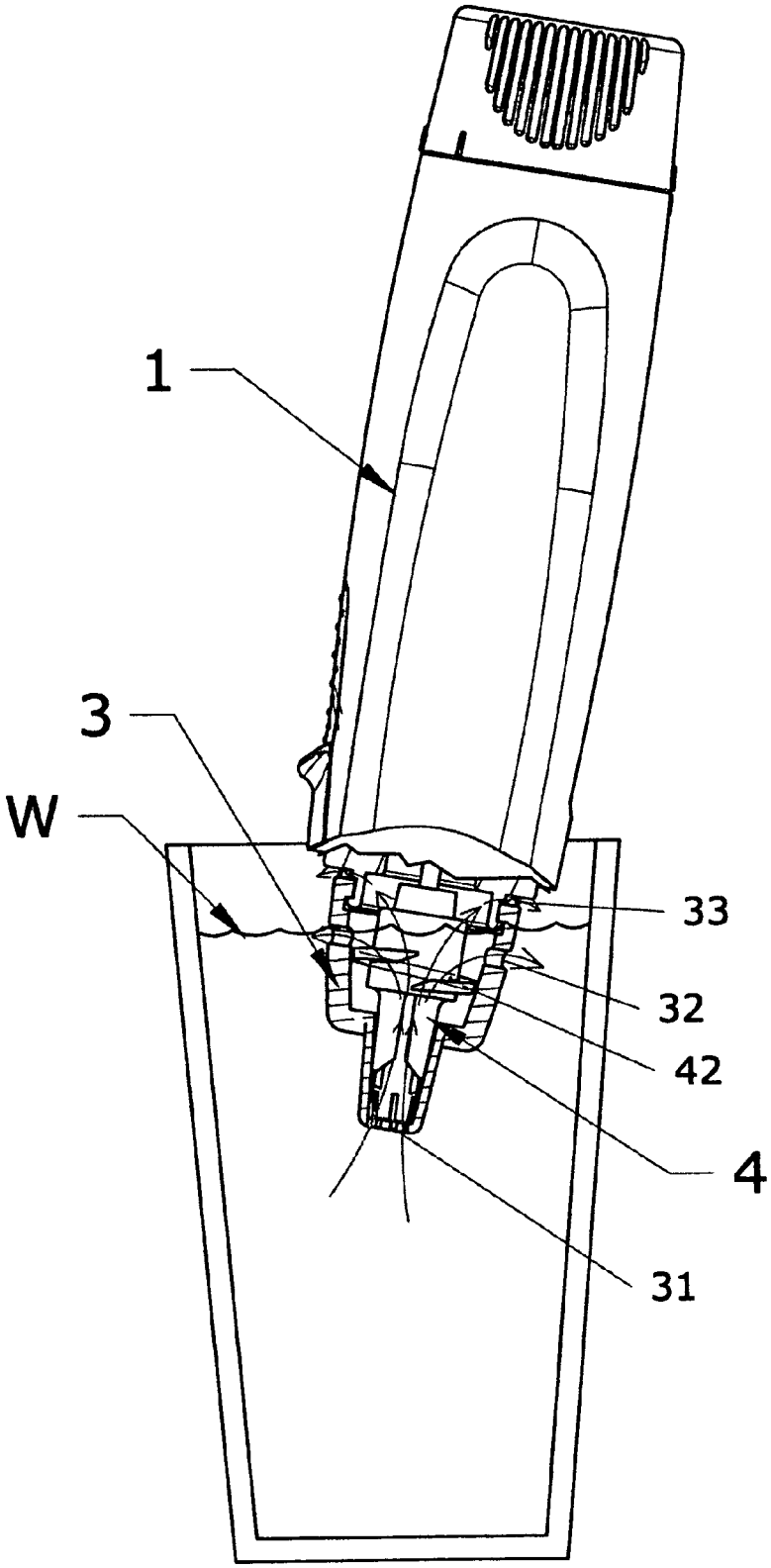
FIG. 5 shows a schematic view of a usage and a function of the present invention.

As shown in FIG. 5, the blade seat member of an electric nose hair cutter is put into detergent W upon using. When the inner blade seat 4 rotates clockwise, the spiral guiding plate 42 sucks the detergent W upward through the front hole 31, passes the detergent W through the entire inner barrel 34, and then expels the detergent W through the lower holes 32,33.

Figure 6:
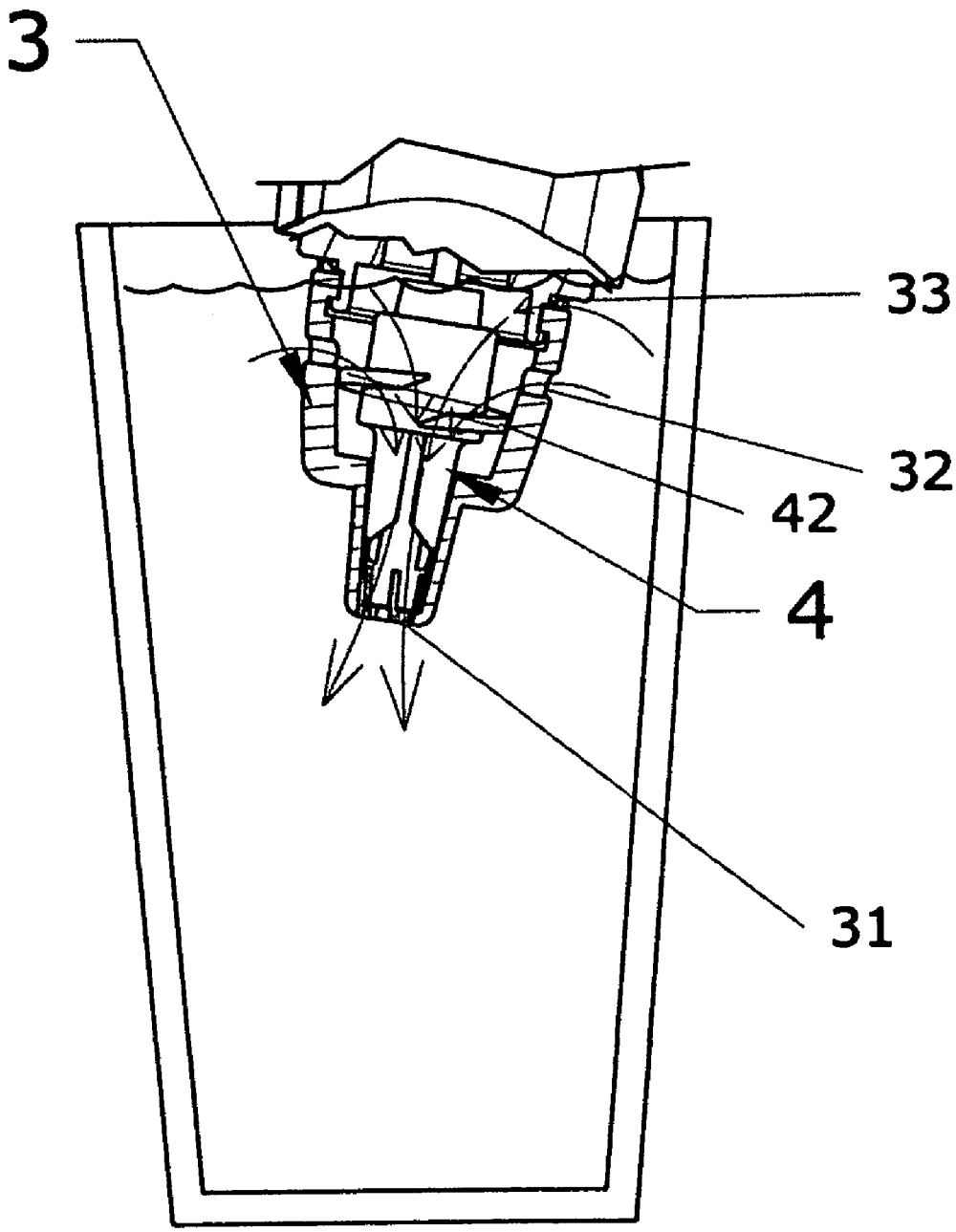
FIG. 6 shows a schematic view of a reverse flushing function of the present invention.
Figure 7:
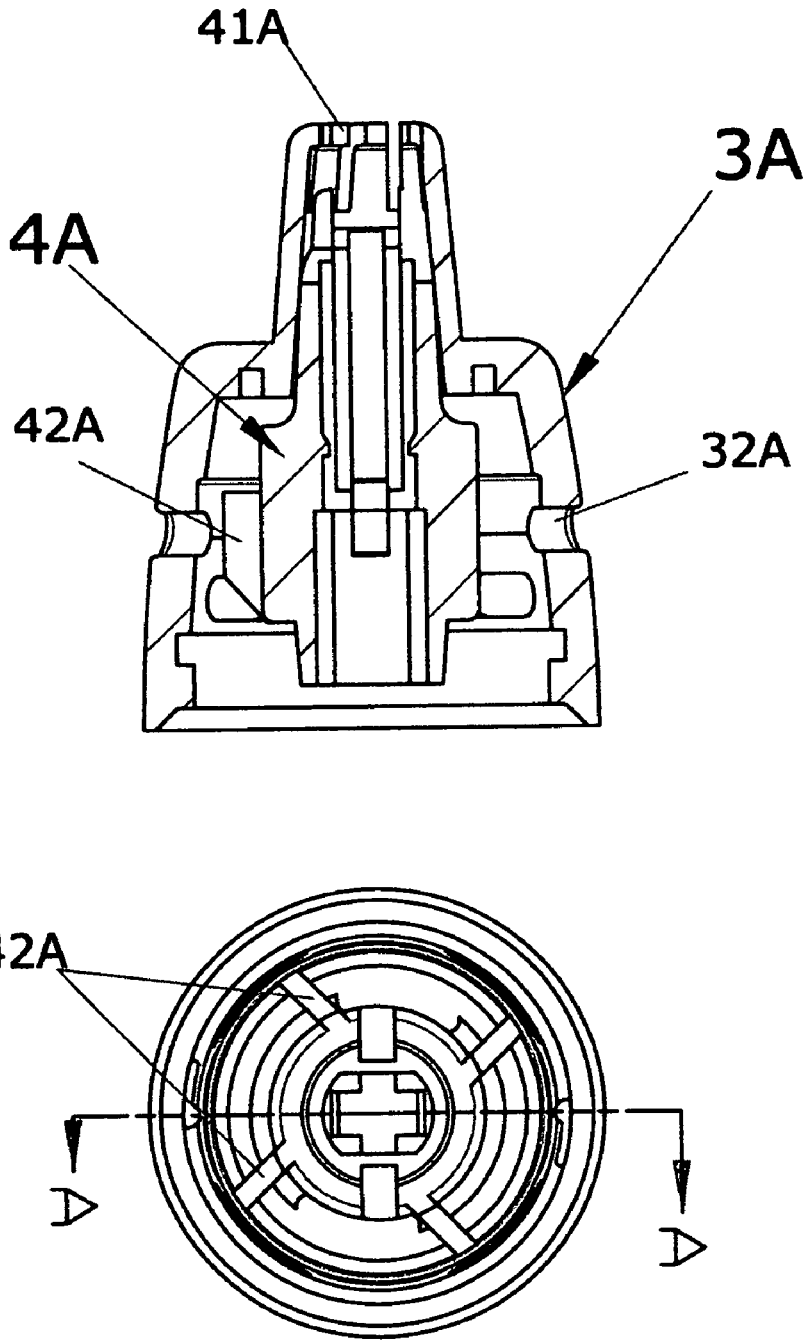
FIG. 7 shows a sectional view of an improved flushing structure of a conventional electric nose hair cutter.

Referring to FIG. 6, it shows a schematic view of a reverse flushing of the present invention. The blade seat member of an electric nose hair cutter is put into detergent W upon using. When the inner blade seat 4 rotates counterclockwise, the spiral guiding plate 42 sucks the detergent W inward through the lower holes 32, 33, passes the detergent W through the entire inner barrel 34, and then expels the detergent W through the front hole 31.

Accordingly, when the electric nose hair cutter can be configured to rotate clockwise and counterclockwise, an alternate flushing can be achieved, thereby enabling a more thorough cleaning and greatly reducing a possibility of leaving hair debris.

It is of course to be understood that the embodiments described herein is merely illustrative of the principles of the invention and that a wide variety of modifications thereto may be effected by persons skilled in the art without departing from the spirit and scope of the invention as set forth in the following claims.

I claim:

1. A flushing and flow guiding device for an electric nose hair cutter, the guiding device comprising:

an inner blade seat with a spiral guiding plate located at an outer periphery of the inner blade seat;

an outer blade seat being a cylinder whose top end is provided with a front hole and whose lower section is provided with lower holes; and an inner barrel mounted on the inner blade seat, an outer radius of the spiral guiding plate being close to the inner barrel on the inner blade seat; the spiral guiding plate driving detergent in the inner barrel upon rotating, so as to quickly suck in detergent and quickly expel the detergent for flushing nose hair debris in the blade seats.

* * * * *